US005939104A

United States Patent [19]

Johnston

[11] Patent Number: 5,939,104

[45] Date of Patent: Aug. 17, 1999

[54] APPARATUS FOR FORMING A MULTILEVEL CONCRETE PRODUCT

[75] Inventor: Llewellyn L. Johnston, Vancouver, Wash.

[73] Assignee: Columbia Machine, Inc., Vancouver, Wash.

[21] Appl. No.: 09/021,733

[22] Filed: Feb. 11, 1998

[51] Int. Cl.[6] ..... B28B 3/08

[52] U.S. Cl. ..... 425/356; 264/297.9; 264/333; 425/412

[58] Field of Search ..... 425/338, 356, 425/412, 416; 249/118, 119, 129; 264/228, 297.9, 333

[56] References Cited

U.S. PATENT DOCUMENTS

| | | | |
|---|---|---|---|
| 798,797 | 9/1905 | Johnson | 249/149 |
| 1,642,247 | 9/1927 | Krause | 249/102 |
| 1,652,855 | 12/1927 | Fernandez | 428/10 |
| 1,688,627 | 10/1928 | Long | 425/123 |
| 1,887,403 | 11/1932 | Evans | 425/385 |
| 2,091,139 | 8/1937 | Crowell | 249/129 |
| 2,121,439 | 6/1938 | Menzel | 249/97 |
| 2,904,870 | 9/1959 | Hillberg | 249/191 |
| 3,360,231 | 12/1967 | Van Hezik | 249/129 |
| 4,123,034 | 10/1978 | Crunk et al. | 249/156 |
| 4,442,995 | 4/1984 | Grady, II | 249/139 |
| 4,451,022 | 5/1984 | Sauger | 249/2 |
| 5,059,110 | 10/1991 | Allison et al. | 425/260 |
| 5,297,772 | 3/1994 | Stefanick | 249/102 |
| 5,395,228 | 3/1995 | Aeseth et al. | 425/253 |
| 5,409,193 | 4/1995 | Baxter | 106/456 |
| 5,542,837 | 8/1996 | Johnston | 425/183 |

FOREIGN PATENT DOCUMENTS

| | | |
|---|---|---|
| 630230 | 7/1963 | Belgium . |
| 508048 | 12/1919 | France . |
| 25 56 511 | 6/1977 | Germany . |
| 856809 | 8/1981 | U.S.S.R. . |

OTHER PUBLICATIONS

Columbia Machine, "Mold Box Assembly", pp. 2.4–2.5 (1994).

Columbia Machine, "Mold Adaptor (C–200–2269)", (1980).

Columbia Machine, "Adaptor—Final Machining (B699582.25.1)", (1990).

Columbia Machine, "Mold Adaptor (D–200–3124)", (1986).

Columbia Machine, "Mold Box Assembly", pp. 2.1–2.105 (1994).

*Primary Examiner*—Patrick Ryan
*Assistant Examiner*—Mark A. Wentink
*Attorney, Agent, or Firm*—Marger Johnson & McCollom, P.C.

[57] ABSTRACT

A mold box assembly includes a rectangular mold box frame having a substantially vertical divider plate mounted on the frame and extended part-way into it from an the upper side of the frame. A pair of rectangular restrictor plates are disposed vertically in the mold box from side to side and extend to the same depth as the divider plate. Wet product mix is dropped onto the box and is thereafter compressed with a shoe assembly. The shoe assembly includes a pair of shoes that extend from one side of the mold box to the other and have a thickness that allows them to be interleaved with the restrictor plates. The shoes are lowered to the lower edge of the restrictor plates. Simultaneously, another shoe mounted on the head plate compresses product on the other side of the divider plate so a higher level thus forming a header block having a first lower height formed beneath the restrictor plates and a second higher height formed on the other side of the divider plate.

11 Claims, 7 Drawing Sheets

APPARATUS FOR FORMING A MULTILEVEL CONCRETE PRODUCT

BACKGROUND OF THE INVENTION

1. Field of the Invention

The present invention relates generally to methods and apparatus for molding concrete products and more particularly to such methods and apparatus for molding concrete products having compressed surfaces at different levels on one side thereof.

2. Description of the Related Art

Machines for molding concrete products such as bricks, pavers, blocks and the like are known in the art. Examples of such machines are disclosed in U.S. Pat. Nos. 5,395,228 and 5,059,110 for apparatus for forming concrete block, both of which are owned by the assignee of the present application and are hereby incorporated herein for all purposes. Concrete products are formed by such machines using mold boxes that are mounted on the machine.

A typical mold box includes a rectangular mold box frame having a pair of opposed parallel mounting brackets that are used to mount the frame on the molding machine. A pair of opposed parallel end plates are disposed between the mounting brackets and complete the mold box frame. Often a plurality of partition plates divide the mold box into separate cavities with a separate block, brick or paver being formed in each cavity.

After, such a mold box is mounted on the molding machine, a substantially planar steel pallet is urged against the underside of the mold box. A feed drawer extends over the box and drops a load of wet product-mix into the box, substantially filling it. Next, a shoe assembly mounted on the molding machine moves downwardly toward the mold frame box. Each shoe includes a compression surface that fits into one of the cavities and compresses the mix, thereby forming a block, e.g., in each mold cavity. Typically the molding machine vibrates the mold box during compression to compact the mix and enhance the strength of the finished product.

After compression, the pallet and shoes moves downwardly at the same rate thus stripping the product from each mold cavity and leaving it sitting on the pallet for curing.

Some concrete products are multilevel products, such as the header block indicated generally at 10 in FIG. 1, rather than being a hexahedron. For example, header block 10 includes a first surface 12 and a second surface 14.

Header block 10 may be formed using a prior art mold box assembly, like mold box assembly 16 in FIGS. 3 and 4. Mold box assembly 16 includes a mold box frame 18 that includes a pair of opposed substantially parallel mounting brackets 20, 22 and a pair of opposed substantially parallel end plates 24, 26. Mounting brackets 20, 22 and end plates 24, 26 are bolted together as shown to form mold box frame 18.

Partition plates 28, 30, 32, 34 divide the mold into three cavities, namely cavity 36, between partition plates 28, 30; cavity 38, between partition plates 30, 32; and cavity 40 between partition plates 32, 34. As will soon be described, a header block—like header block in FIG. 10—is molded in each cavity.

Associated with each cavity is a core bar assembly, like core bar assembly 42 is associated with cavity 36. The core bar assembly includes a substantially vertical divider plate 44 that has a first horizontal flange 46 welded to one end of the divider plate and a second horizontal flange 47 welded to the other end. The divider plate extends between end plates 24, 26. One end of the divider plate is secured to end plate 26 via bolts through holes, like the holes visible in FIG. 3, on flange 46. Flange 47 includes similar bolt holes for securing the other end of the divider plate to end plate 24. Substantially identical core bar assemblies 48, 50 are secured in a like manner to end plates 24, 26.

When mold box assembly is used to form header blocks, like head blocks 10 in FIG. 1, the assembly is mounted on a molding machine, like those referred to above, via mounting brackets 20, 22 in a known manner. A steel pallet 51 is urged against the underside of mold box frame 18. During block molding, a feed drawer assembly (not shown) associated with the molding machine extends over the top of assembly 16 and drops a predetermined load of mix into cavities 36, 38 and 40. Excess mix is scraped from the top of the mold assembly by a scrape-off plate (not shown) associated with the molding machine. The scrape-off plate has a shape complementary to the upper profile of the mold box assembly as viewed in FIG. 4 and is moved across the assembly from one of end plates 24, 26 to the other thus scraping off excess mix.

The block machine includes a head plate (not shown) having shoes (also not shown) mounted thereon that extend downwardly therefrom above each of the cavities in assembly 16. Each cavity is beneath a high shoe and a low shoe. For example, in cavity 36, the high shoe compresses mix in the cavity on the left side of divider plate 44 between partition plate 28 and divider plate 44. The low shoe compresses mix in the cavity between divider plate 44 and partition plate 30. Each of the cavities has associated therewith a corresponding high and low shoe thus compressing the mix to form three header blocks, like header block 10 in FIG. 1.

As known in the art, the mold box assembly is vibrated during compression to compact the mix. This increases the strength of the compressed product. After sufficient compression and vibration, steel pallet 51 is lowered from the underside of the mold box assembly while the shoes are lowered thus stripping the product from mold box assembly 16 and leaving three blocks, like block 10, sitting on pallet 51.

Mold box assembly 16 is disadvantageous because special baffles, wiper assemblies and a scrape-off plate must be installed on the molding machine to use mold box assembly 16 to make header blocks. This causes the molding machine to be down for substantial periods when changing to or from a header-block making operation using a mold box assembly like assembly 16.

Another prior art mold box assembly and method is used to make a hollow core header block, like header block 52 in FIG. 2. Header block 52 includes a front surface 53 and a pair of hollow cores 54, 56 that are formed by a pair of corresponding core forms 58, 60 on a core bar assembly 62. Header block 52 includes an upper compressed surface 64, a lower compressed surface 66 and a pair of chamfered surfaces 68, 70.

Core bar assembly 62 includes a core bar 72 to which of each core form 58, 60 is attached. Each core form, like core form 58—which depends from core bar 72—includes a lower-surface portion, like lower-surface portion 74 on core form 58. A downwardly directed shoulder 76 defines the transition between lower-surface portion 74 and an upper-surface portion 78. Surface 70 is formed by a corresponding chamfer (not visible) on the underside of shoulder 76. Core form 60 is similarly constructed.

In operation, core bar assembly 62 is suspended from a pair of opposed parallel end plates in a mold box assembly including end plates and mounting brackets. A pair of partition plates extend from one end plate to another to define front and rear surfaces, like front surface 53 and the opposed parallel rear surface (not visible) of header block 52. The lower-most surface of core forms 58, 60 is urged against a steel pallet (not shown) that is urged against the underside of the mold box assembly.

When wet product mix is dropped into the mold box frame, the high side of the header block fills between core forms 58, 60 to a level slightly above upper surface 64. The low side of the cavity in which block 52 is formed, however, fills only to a level slightly above surface 66. This is due to the narrower dimension defined between upper-surface portion 78 and the partition plate relative to the wider dimension between the core form and the rear surface—opposite surface 74—of block 52. Because the low side of block 52 is approximately half the height of the rear side, the surface area of surface 66 is approximately half the surface area of surface 64. It can therefore be seen that only about half of the mix is supplied to the low side of the mold than to the rear side of the mold.

Although the foregoing procedure is adequate to make hollow core header blocks, it can not be used to make solid header blocks, like header block 10 in FIG. 1.

It is accordingly an object of the present invention to provide a method and apparatus for making multilevel blocks, like header blocks, which overcomes the disadvantages associated with prior art methods and apparatus.

It is more specific object to provide such a method and apparatus that utilizes a mold box assembly that can be quickly installed on and removed from a block making machine.

It is another more specific object of the present invention to provide such a method and apparatus that produces a relatively strong block by compressing a substantial portion of the lower level block surface.

It is still another more specific object of the present invention to provide such a method and apparatus that distributes compression relatively uniformly over the lower block surface.

It is yet another more specific object of the present invention to provide such a method and apparatus that may be used to make solid multilevel blocks.

SUMMARY OF THE INVENTION

A mold box for forming a multilevel molded product includes a mold box frame. A substantially vertical divider plate extends part way into the frame from an upper side thereof. First and second shoes compress product mix to a first level on a first side of the divider plate, while a third shoe compresses mix to a second level on a second side of the divider plate. A substantially vertical restrictor plate is mounted on the frame and extends substantially between the first and second levels. The shoes are mounted on a head plate positioned over the mold box. The first and second shoes are spaced apart from one another to permit them to straddle the restrictor plate when the head plate moves downwardly to compress mix to the first and second levels.

A method for making multilevel block using the mold box assembly of the present invention is also provided.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
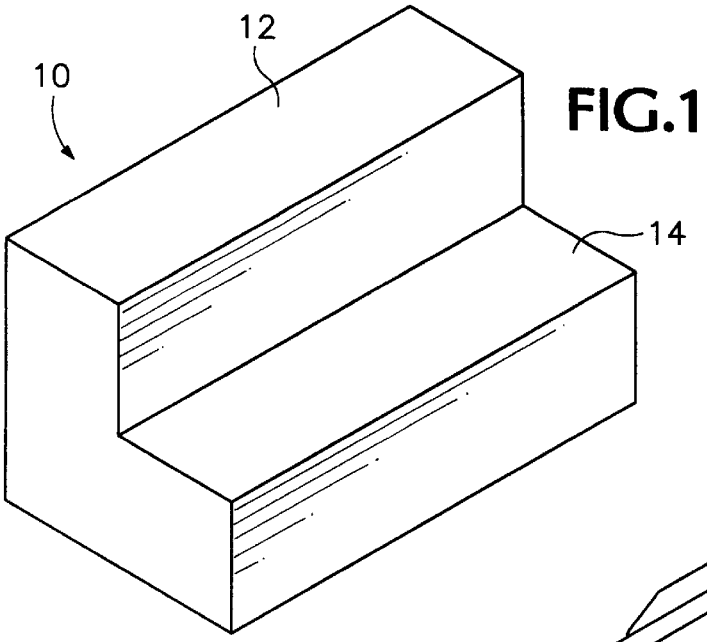
FIG. 1 is a perspective view of a solid header block.
Figure 2:
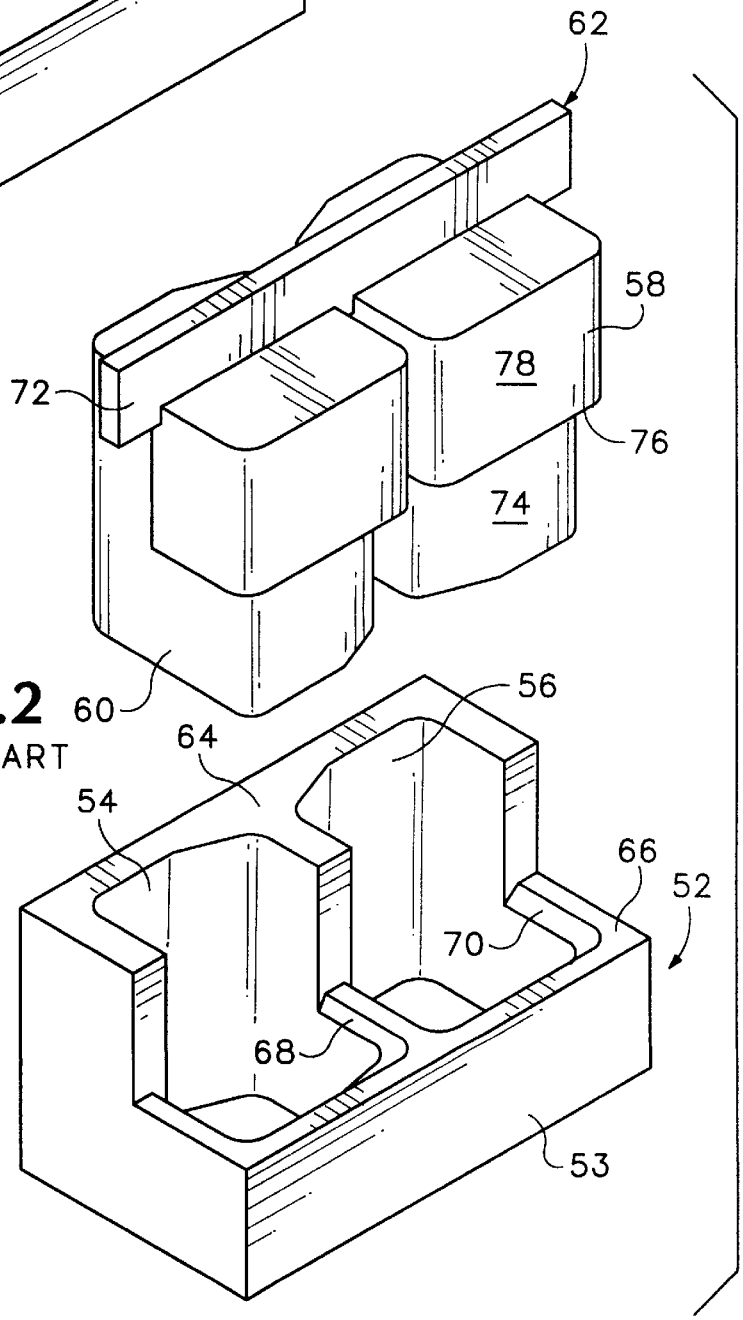
FIG.2 PRIOR ART
FIG. 2 is a perspective view of a hollow-core header block and an associated core bar assembly used in making the header block.
Figure 3:
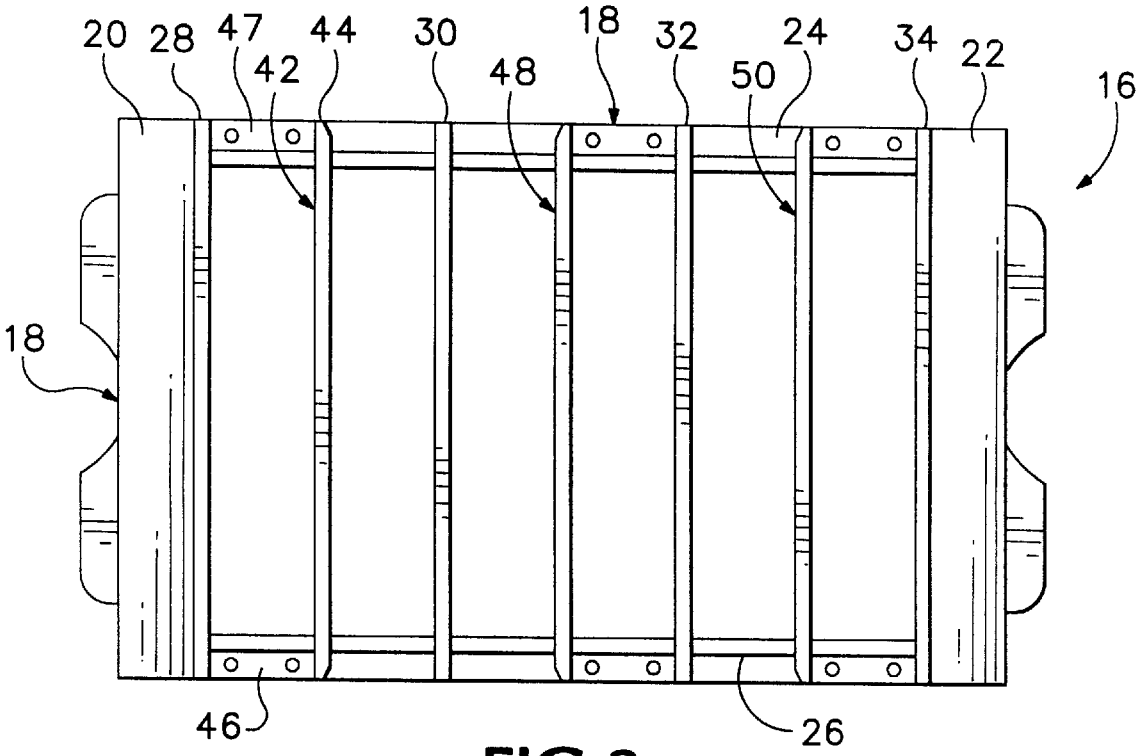
FIG.3 PRIOR ART
FIG. 3 is a top plan view of a prior art mold for making a solid header block.
Figure 4:
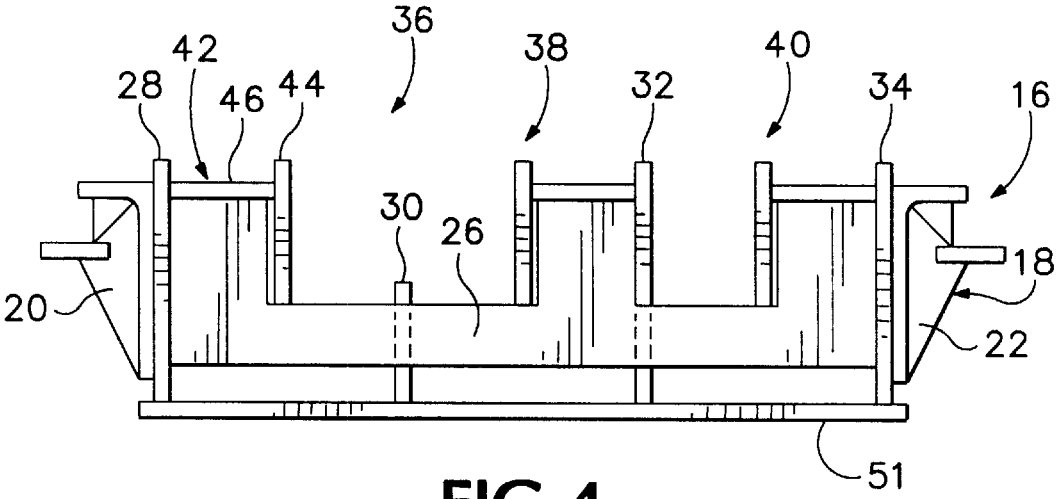
FIG.4 PRIOR ART
FIG. 4 is a front elevation view of the mold in FIG. 3.
Figure 5:
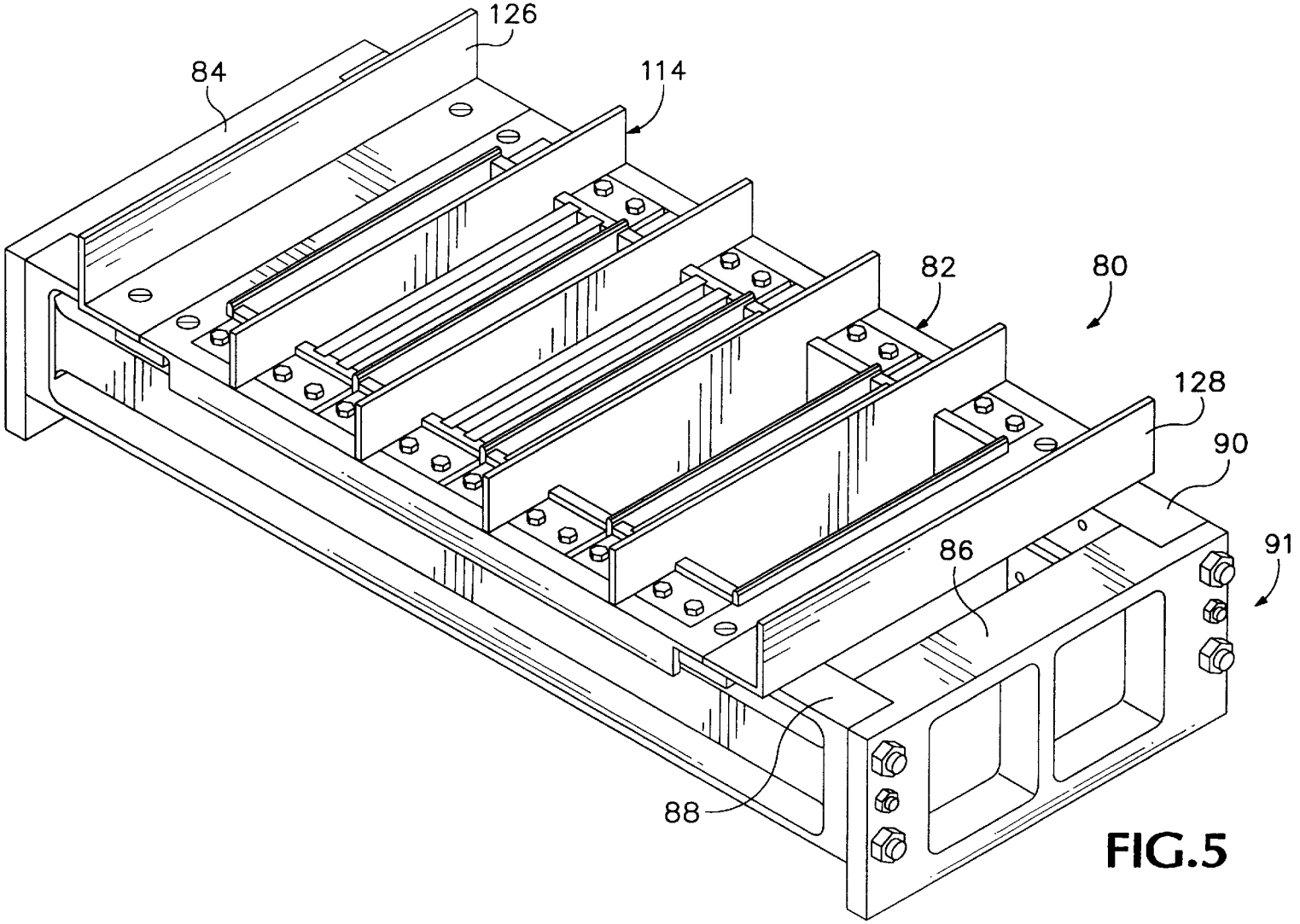
FIG. 5 is a perspective view of a mold for making solid header blocks constructed in accordance with the present invention.
Figure 6:
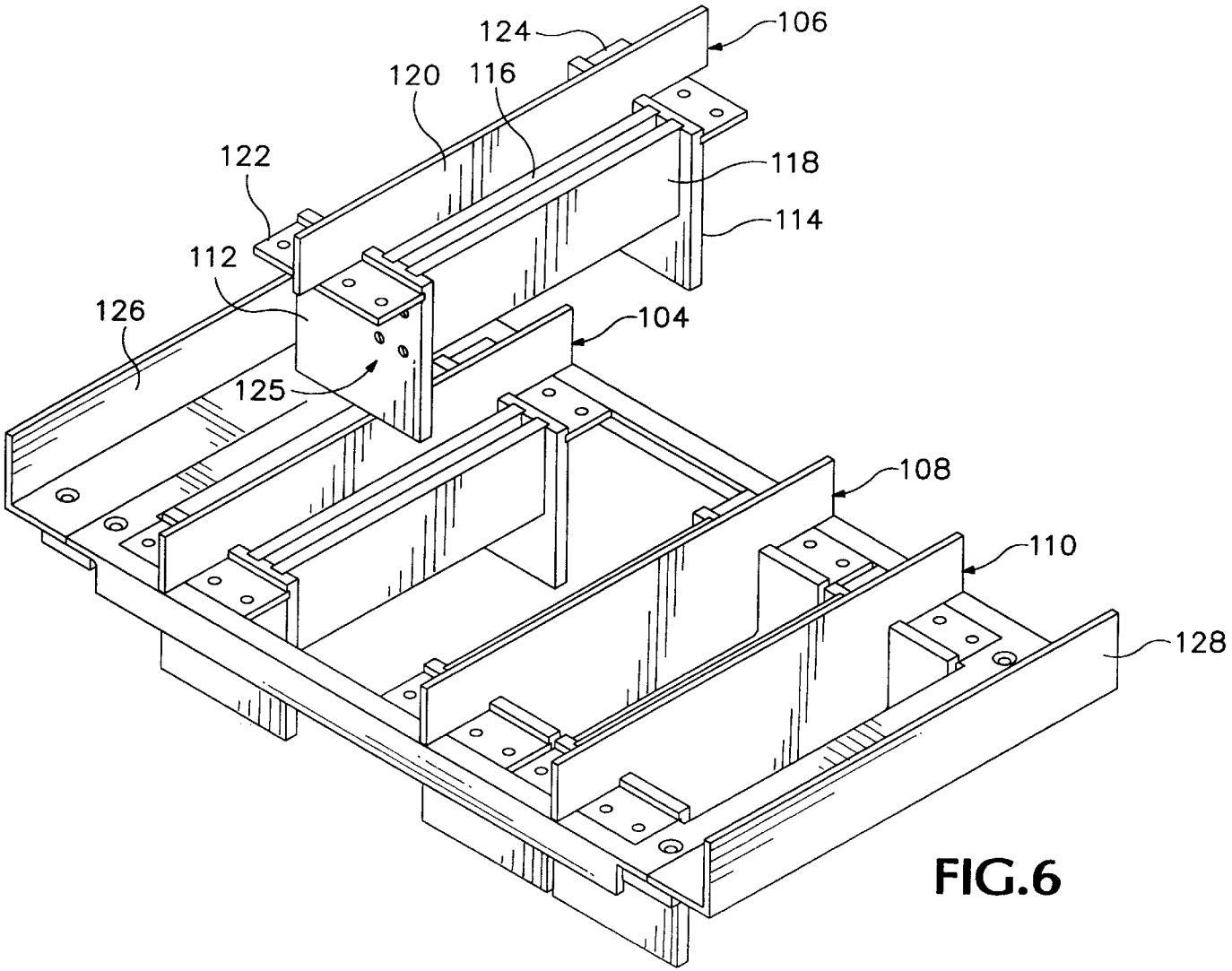
FIG. 6 is a perspective partially-exploded view of an upper portion of the mold box assembly in FIG. 5.
Figure 7:
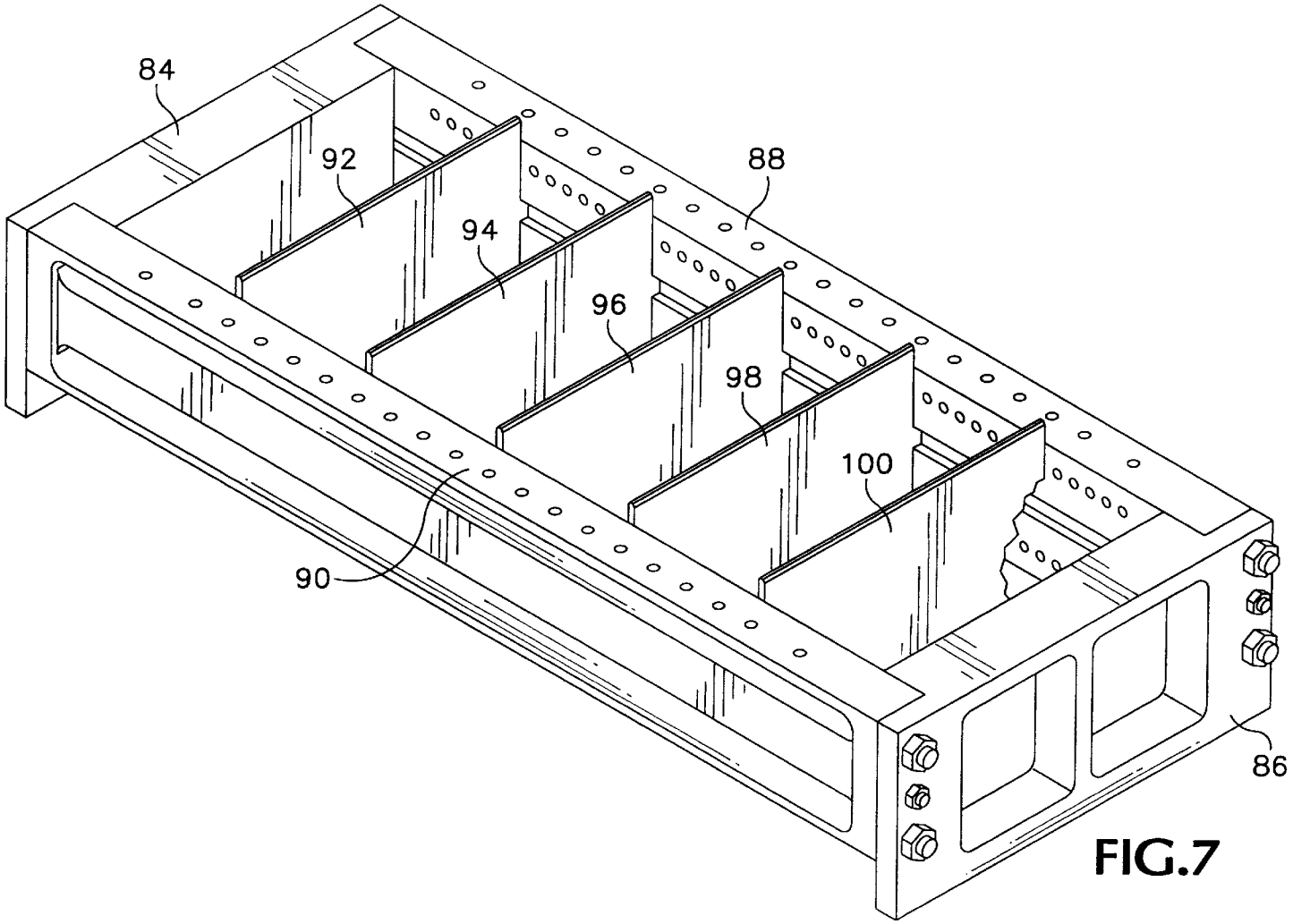
FIG. 7 is a perspective view of a lower portion of the mold box assembly of FIG. 5.

Considering now FIGS. 5–7, indicated generally at 80 is a mold box assembly constructed in accordance with the present invention. The mold box assembly includes a mold box frame 82 formed from a pair of opposed substantially parallel mounting brackets 84, 86 and opposed substantially parallel end plates 88, 90. The end plates and mounting brackets are bolted together and aligned using an alignment pin and bolts, one set of which is indicated generally at 91. The pin and bolts are as constructed and described in U.S. Pat. No. 5,743,510 assigned to the assignee of the present invention, which is incorporated herein by reference for all purposes.

In FIG. 7, a plurality of partition plates 92, 94, 96, 98, 100 define four cavities within the mold box: a first between plates 92, 94; a second between plates 94, 96; a third between plates 96, 98; and a fourth between plates 98, 100.

Turning now to FIG. 6, four core bar assemblies 104, 106, 108 and 110 are each received in one of the cavities formed between the partition plates (not shown in FIG. 6). The exploded portion of FIG. 6 includes core bar assembly 106 as well as an associated pair of opposed end liners 112, 114 and a pair of restrictor plates 116, 118 mounted on the end liners. Each of the other core bar assemblies 104, 108 and 110 has substantially identical end liners associated therewith. The end liners and partition plates are preferably installed in the mold box frame using the device in U.S. Pat. No. 5,542,837 for mold box assembly with partition plates assigned to the assignee of the present application, which is hereby incorporated by reference for all purposes.

Figure 8:
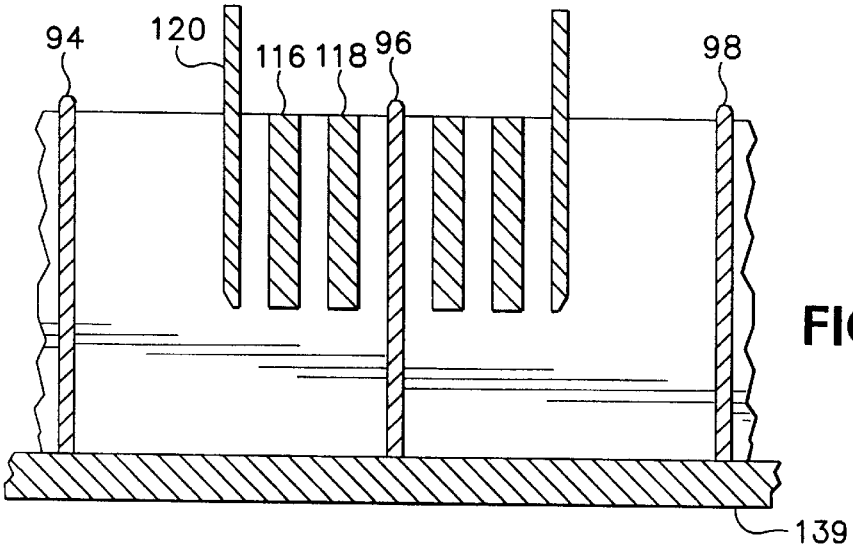
FIG. 8 is a partial cross-sectional view of the mold box assembly in FIG. 5.

Core bar assembly 106 includes a divider plate 120, which is welded to a pair of flanges 122, 124. The flanges include bores therein as shown for bolting the core bar assembly to the top of end plates 88, 90 as shown in FIG. 5. A cross-sectional end view of divider plate 120 and restrictor plates 116, 118 is shown at FIG. 8. The ends of the restrictor plates are received in corresponding slots milled in end liners 112, 114 and are secured therein via screws, like the screws indicated generally at 125.

Each of the other core bar assemblies is formed in substantially the same fashion as core bar assembly 106. It should be noted however, that the restrictor plates associated with core bar assemblies 108, 110 are on the left side as viewed in FIG. 8, while the restrictor plates associated with core bar assemblies 104, 106 are on the right side. A pair of pan angles 126, 128 in FIGS. 5 and 6 constrain wet product mix, also referred to herein as product, when it is dropped into the mold box assembly from above, as will be later described in more detail.

Figure 9:
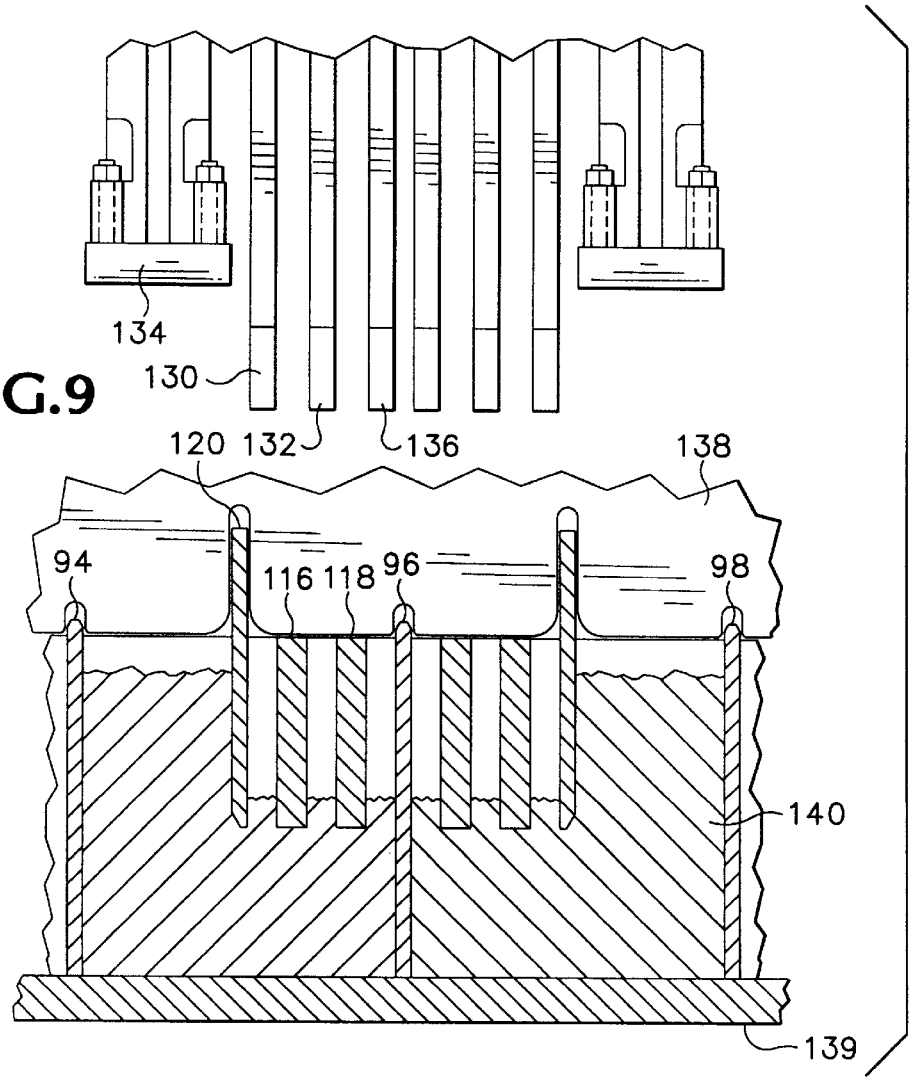
FIG. 9 is a view similar to view FIG. 8 after product mix is dropped in the mold box assembly, and depicting compression shoes above the mold box assembly.

Turning now to FIG. 9, included therein are shoes 130, 132 referred to herein as first and second shoes, respectively. Also included are shoes 134 and 136, with shoe 134 being referred to herein as a third shoe. Each of the shoes includes a downwardly directed compression surface. Shoe 134 has a width substantially equal to the distance between divider plate 120 and partition plate 94 and in length extends between end liners 112, 114 when the shoe is in a lower position, as depicted in FIG. 10.

Shoe 130 has a width substantially equal to the distance between divider plate 120 and restrictor plate 116; shoe 132 has a width substantially equal to the distance between restrictor plates 116, 118; and shoe 136 has a width substantially equal to the distance between restrictor plate 118 and partition plate 96. As is the case with shoe 134, each of shoes 130, 132, 136 extend substantially between end liners 112, 114 when the shoes are lowered as in FIG. 10.

Figure 10:
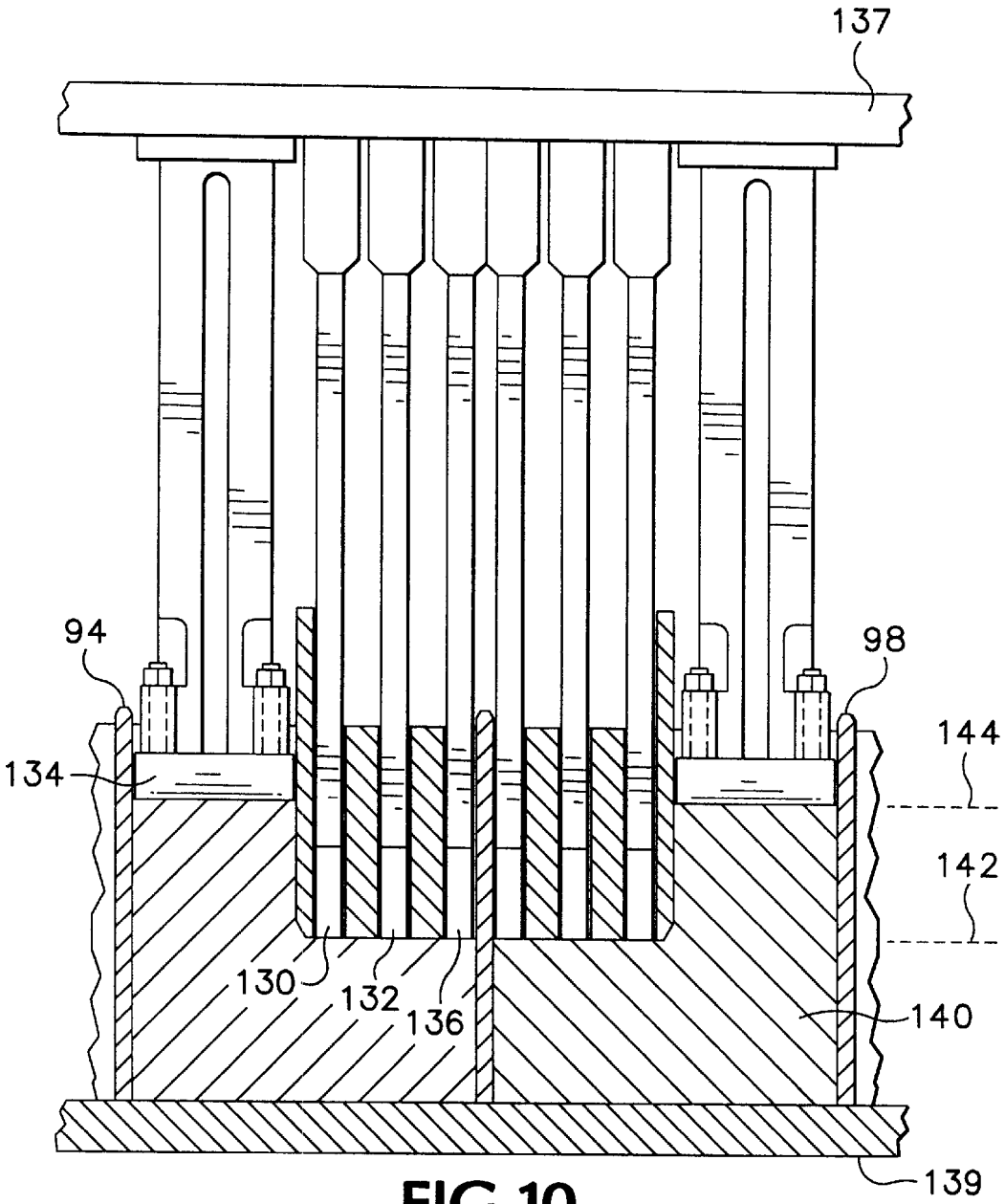
FIG. 10 is a view similar to FIG. 9 during compression of the mix by the shoes.

Finishing now the description of the structure associated with the mold box assembly, in FIG. 10 a head plate 137 is mounted on the molding machine and has the shoes depending therefrom via head plungers as shown. In FIG. 9, a scraper plate 138 has a lower edge complimentary to the upper surface of the mold box assembly. As will be shortly described, scrapper plate 138 moves laterally across the top of the box between end plates 88, 90 to wipe excess product mix from the top of the mold assembly prior to compression.

In operation, mold box assembly 80 is secured to a block machine of the type described above via mounting brackets 84, 86. A steel pallet 139 (in FIGS. 8, 9, and 10) is urged against the under side of the mold box frame. During a fill operation, a feed drawer (not shown) mounted on the block machine extends over the top of the mold assembly, which is assembled as shown in FIG. 5. The feed drawer drops wet mix on the mold assembly substantially between pan angles 126, 128 and between the end plates 88, 90. Next, the block machine moves scrape-off plate 138 across the top of the mold assembly as shown in FIG. 9, thus removing excess mix from the top of the mold assembly. The mold assembly is thus filled with wet mix 140 as depicted in FIG. 9. Next, the block machine lowers head plate 137 (in FIG. 10) thereby lowering the shoes from the position shown in FIG. 9, which is referred to herein as a first retracted position, to the position shown in FIG. 10, which is referred to herein as a second compressed position.

In the second compressed position, the compression surface of each shoe is urged against mix 140 while the mold box assembly vibrates. This compacts mix 140 to provide a denser, stronger product. As can be seen in FIG. 10, the first and second shoes, shoes 130, 132 respectively, compress mix 140 to the level of a dashed line 142, while the third shoe 134 compresses to dashed line 144. The distance between dashed line 142 and the upper surface of pallet 139 is referred hereinto as the first product dimension while the distance between dashed line 144 and the upper surface of pallet 139 is referred to as a second product dimension. The level of lines 142, 144 is also referred to herein as first and second levels, respectively.

After sufficient compression, pallet 139 is lowered away from the underside of mold box frame 82 as the head plate 137 continues further downward movement (at the same rate as pallet 139) thus stripping the formed header blocks, four in all, from the lower side of the mold. The blocks are transported for curing on the pallet.

It can thus be seen that the restrictor plates and the divider plate limit the amount of mix that fills the mold cavity beneath these plates. This is so because mix can only fall in the spaces on either side of the plates. On the other side of the divider plate, where shoe 134 compresses product mix, however, the mix falls unobstructed during the fill step. Thus, in the case of the present embodiment, approximately one half of the surface area on the first side of the divider plate is obstructed by the restrictor plates. During fill the other side of the divider plate consequently fills approximately twice as high as the side with the restrictor plates. The plates therefore block an appropriate amount of fill to create the first dimension of the header block, while the cavity in which the second dimension of the block is formed is able to fill to a level to permit formation of the thicker portion of the product.

In can consequently be seen that for a product having a very thin portion, not much product mix is required and therefore the restrictor plates over the thin portion need to be quite thick. This leaves only narrow spaces on either side of the restrictor plates and permits only a small amount of mix into the mold relative to the unobstructed side of the divider plate. This will of course require that the shoes, like shoes 130, 132, 136, have thicknesses that correspond to the width of the spacing on either side of the restrictor plates. In other words, complimentary restrictor plates and shoes need to be provided for a particular thickness of product.

At the other extreme, in the case where a multilevel product has one high level, like on the left side of divider plate 120 as shown in FIG. 9, and another lower level that is only slightly lower than the left side, very thin restrictor plates 116, 118 are required. This leaves relatively wide spaces on either side of the restrictor plates and permits most, but not all, of the product mix to fall beneath the plates. This will require shoes, like shoes 130, 132, 136, wider than that depicted in FIG. 9 so as to substantially fill the space in which the shoe is received during compression.

The lower surfaces of divider plate 120, shoes 130, 132, 136 and restrictor plates 116, 118 in FIG. 9 are referred to herein as a substantially continuous surface spaced from the lower level of the mold box by the first product dimension. It can be seen that not all of the first product dimension is compressed as those portions beneath the restrictor plate are not exposed to compression force. Compression is, however, relatively uniformly distributed over the first product dimension thus providing a uniformly strong block throughout the first dimension.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A mold assembly for forming a multilevel molded product comprising:

a mold box frame;

a substantially vertical divider plate extending part way into the frame from an upper side thereof;

a first shoe for compressing product to a first level on a first side of said divider plate;

a second shoe for compressing product to the first level on the first side;

a third shoe for compressing product to a second level on a second side of said divider plate;

a substantially vertical restrictor plate mounted on the frame and extending substantially between said first and second levels; and a head plate positionable over said mold box frame and having each of the shoes operatively connected thereto, said first and second shoes being spaced apart from one another to permit them to straddle the restrictor plate when the head plate moves downwardly.

2. The mold assembly of claim 1 wherein the assembly further includes:

a plurality of substantially vertical restrictor plates mounted on the frame and extending substantially between the first and second levels; and a plurality of shoes operatively connected to said head plate and interleaved with said restrictor plates when said head plate moves downwardly.

3. The mold assembly of claim 2 wherein the spacing between said restrictor plates is inversely proportional to a distance said plates extend into the mold box frame.

4. A mold box assembly comprising:

a mold box frame;

a substantially vertical restrictor plate extending part way into the frame from an upper side thereof and having a lower surface;

first and second shoes each defining a compression surface for compressing product in the mold box frame; and a head plate having each of said shoes operatively connected thereto, said head plate being movable between a first retracted position above said mold box frame and a second compressed position in which said shoes straddle said restrictor plate and said restrictor plate lower surface and said shoe compression surfaces define a substantially continuous surface.

5. The mold box assembly of claim 4 wherein said mold box assembly further comprises:

a substantially vertical divider plate extending part way into the frame from an upper side thereof; and a third shoe having a compression surface and being operatively connected to the head plate, said first and second shoes compressing product on a first side of said divider plate and the third shoe compressing product on a second side of said divider plate when said head plate is in the compressed position.

6. The mold box assembly of claim 5 wherein said substantially continuous surface is at a first level and said third-shoe compression surface is at a different, second level when said head plate is in the compressed position.

7. The mold box assembly of claim 6 wherein said mold box assembly further includes:

a plurality of substantially vertical restrictor plates mounted on the frame and extending substantially between the first and second levels; and a plurality of shoes operatively connected to said head plate and interleaved with said restrictor plates when said head plate is in the compressed position.

8. The mold assembly of claim 7 wherein a spacing between said restrictor plates is inversely proportional to a distance between said first and second levels.

9. A mold box assembly comprising:

a mold box frame;

a partition plate separating the mold box frame into separate adjacent cavities;

a substantially horizontal head plate disposed over the mold box frame when said mold box assembly is in operative condition;

a first shoe associated with each cavity, said first shoe being mounted on said head plate and having a product compression surface, said first-shoe compression surface defining a first product dimension between a lower level of said mold box frame and the first-shoe compression surface;

a second shoe associated with each cavity, said second shoe being mounted on said head plate and having a product compression surface, said second-shoe compression surface being spaced from the lower level of said mold box frame by the first product dimension;

a third shoe associated with each cavity, said third shoe being mounted on said head plate and having a product compression surface, said third-shoe compression surface defining a second product dimension between the lower level of said mold box frame and the third-shoe compression surface;

a substantially vertical divider plate associated with each cavity and being mounted on said mold box frame, said plate extending part way into the cavity from an upper side thereof and having the first and second shoes on one side thereof and the third shoe on the other side thereof; and a substantially vertical restrictor plate mounted on said frame and having a lower surface that together with a lower surface of said vertical divider plate and said first shoe compression surface define a substantially continuous surface spaced from the lower level of said mold box frame by the first product dimension.

10. The mold box assembly of claim 9 wherein the space between said first and second shoes has a length dimension that extends substantially from a first end plate of the mold box frame to a second end plate and a width proportional to the first product dimension.

11. The mold box assembly of claim 9 wherein the first product dimension is smaller than the second product dimension.

* * * * *

UNITED STATES PATENT AND TRADEMARK OFFICE

CERTIFICATE OF CORRECTION

PATENT NO. : 5,939,104
DATED : August 17, 1999
INVENTOR(S) : Johnston

It is certified that error appears in the above-identified patent and that said Letters Patent is hereby corrected as shown below:

Title page,
Title, "APPARATUS FOR FORMING..." should read -- METHOD AND APPARATUS FOR FORMING... --;

ABSTRACT,
Line 30, "from an the" should read -- from the --;

Column 3,
Line 31, "It is more specific" should read -- It is a more specific --;

Column 4,
Line 47, "106" should read -- 104 --;
Line 67, "106" should read -- 104 --.

Signed and Sealed this

Twenty-ninth Day of January, 2002

*Attest:*

*Attesting Officer*

JAMES E. ROGAN
*Director of the United States Patent and Trademark Office*